US012486469B2

(12) United States Patent
Seo et al.

(10) Patent No.: US 12,486,469 B2
(45) Date of Patent: Dec. 2, 2025

(54) LUBRICANT COMPOSITION FOR BRAKE SYSTEM

(71) Applicant: HYUNDAI MOBIS CO., LTD., Seoul (KR)

(72) Inventors: Kang Won Seo, Yongin-si (KR); Choong Sik Shin, Yongin-si (KR); Hyun Chul Kim, Yongin-si (KR); Yeon Chan Koo, Seoul (KR); Im Gee Baek, Asan-si (KR); Hyun Woong Lee, Asan-si (KR); Han Eum Park, Incheon (KR)

(73) Assignee: HYUNDAI MOBIS CO., LTD., Seoul (KR)

( * ) Notice: Subject to any disclaimer, the term of this patent is extended or adjusted under 35 U.S.C. 154(b) by 0 days.

(21) Appl. No.: 19/022,318

(22) Filed: Jan. 15, 2025

(65) Prior Publication Data

US 2025/0313773 A1 Oct. 9, 2025

(30) Foreign Application Priority Data

Apr. 3, 2024 (KR) ..... 10-2024-0045236

(51) Int. Cl.
*C10M 107/34* (2006.01)
*C10M 125/02* (2006.01)
(Continued)

(52) U.S. Cl.
CPC ..... *C10M 133/12* (2013.01); *C10M 107/34* (2013.01); *C10M 125/02* (2013.01); *C10M 137/08* (2013.01); *C10N 2020/02* (2013.01); *C10N 2020/06* (2013.01); *C10N 2030/06* (2013.01); *C10N 2030/08* (2013.01); *C10N 2030/10* (2013.01); *C10N 2040/08* (2013.01)

(58) Field of Classification Search
CPC ..... C10M 133/12; C10M 107/34; C10M 125/02; C10M 137/08; C10N 2020/02; C10N 2020/06; C10N 2030/06; C10N 2030/08; C10N 2030/10; C10N 2040/08
See application file for complete search history.

(56) References Cited

U.S. PATENT DOCUMENTS 6,339,050 B1 * 1/2002 Park ..... C10M 169/04 508/207
9,023,771 B2 * 5/2015 Mabuchi ..... C10M 171/06 508/113

(Continued)

OTHER PUBLICATIONS

Extended European Search Report issued in corresponding European Patent Application No. 25151883.3 dated May 8, 2025.

*Primary Examiner* — Ellen M McAvoy
(74) *Attorney, Agent, or Firm* — MORGAN, LEWIS & BOCKIUS LLP

(57) ABSTRACT

A lubricant composition with excellent high-temperature operability, the lubricant composition including: 85 wt % to 95 wt % of a polyalkylene glycol base oil; 1 wt % to 5 wt % of an antioxidant; 1 wt % to 5 wt % of a first anti-wear extreme-pressure additive; and 1 wt % to 5 wt % of a second anti-wear extreme-pressure additive, wherein the antioxidant includes an amine-based compound, the first anti-wear extreme-pressure additive includes an amine salt of phosphate, and the second anti-wear extreme-pressure additive includes a nano-diamond dispersion.

10 Claims, 1 Drawing Sheet

(51) Int. Cl.

| | |
|---|---|
| ***C10M 133/12*** | (2006.01) |
| ***C10M 137/08*** | (2006.01) |
| *C10N 20/02* | (2006.01) |
| *C10N 20/06* | (2006.01) |
| *C10N 30/06* | (2006.01) |
| *C10N 30/08* | (2006.01) |
| *C10N 30/10* | (2006.01) |
| *C10N 40/08* | (2006.01) |

(56) References Cited

U.S. PATENT DOCUMENTS

| | | | | |
|---|---|---|---|---|
| 9,175,239 | B2 | 11/2015 | Park et al. | |
| 11,866,672 | B1 * | 1/2024 | Bae | C10M 133/06 |
| 2008/0248979 | A1 * | 10/2008 | Nakagawa | B82Y 30/00 508/130 |
| 2016/0060563 | A1 * | 3/2016 | Kim | C10M 161/00 508/287 |
| 2022/0033730 | A1 * | 2/2022 | Harhausen | C10M 141/08 |
| 2022/0041949 | A1 | 2/2022 | Harhausen et al. | |
| 2023/0313063 | A1 * | 10/2023 | Rittig | C10M 107/34 508/579 |
| 2023/0331959 | A1 * | 10/2023 | Kimoto | C08K 9/04 |
| 2024/0141248 | A1 * | 5/2024 | Cawich | C10M 169/042 |

* cited by examiner

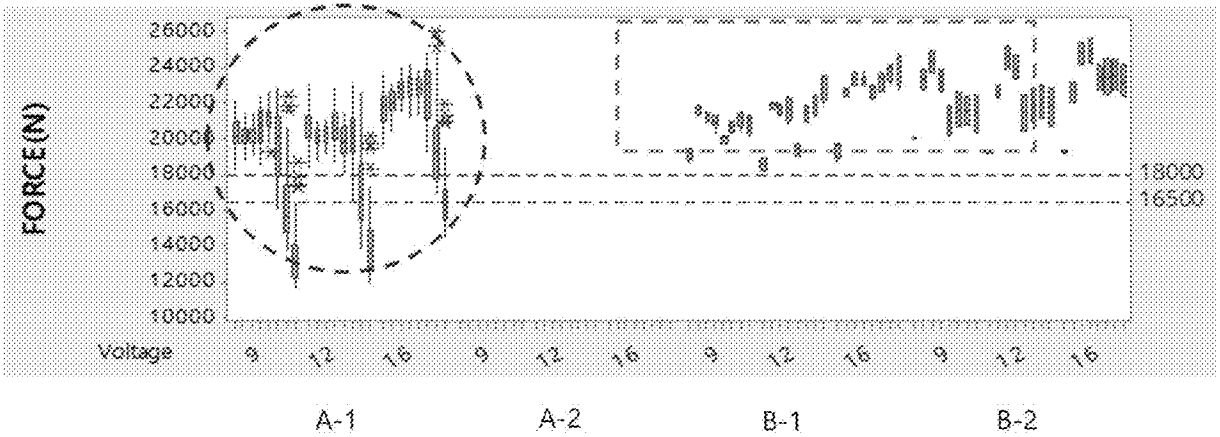
FORCE(N)
26000
24000
22000
20000
18000
16000
14000
12000
10000
Voltage
0
1.2
1.6
0
1.2
1.6
0
1.2
1.6
0
1.2
1.6
A-1
A-2
B-1
B-2
18000
16500

LUBRICANT COMPOSITION FOR BRAKE SYSTEM

CROSS REFERENCE TO RELATED APPLICATION

The present application claims priority to Korean Patent Application No. 10-2024-0045236, filed Apr. 3, 2024, the entire contents of which is incorporated herein for all purposes by this reference.

BACKGROUND

Technical Field

The present disclosure relates to a lubricant composition that is applicable to an electronic parking brake and has excellent high-temperature operability.

Description of the Related Art

Because noise and vibration from automobiles have a negative impact on the performance of automobile parts and cause fatigue of passengers, solutions to reduce them are continuously being researched. In general, grease or lubricants are used to reduce noise caused by friction between automobile parts.

Currently, in automobile brake systems, various types of lubricants such as grease and compounds are used as well as brake fluid, depending on the performance requirements of each part. A parking brake, which is a part of an automobile brake system, has transitioned from manual lever operation as done in the past to a motor-driven electronic parking brake (EPB), which requires grease and lubricants of different performance compared to that of existing lubricants.

In the case of EPB lubricants, not only is there the need for lubrication performance such as anti-wear properties, friction resistance, and extreme-pressure properties, but also for low-temperature performance and high-temperature stability. Thus, grease containing a mixture of a polyalphaolefin (PAO)-based base oil and a thickener in the form of lithium fatty acid salts have been used. Afterwards, EPB parts have also been changed in various ways depending on the size of vehicles, and now, large vehicles such as pickup trucks employ independent EPB parts that are used only for parking brakes. In the case of independent EPBs, a double synthetic rubber (EPDM: Ethylene Propylene Diene Monomer) is used as a sealing material in consideration of compatibility with brake fluid, but the use of PAO-based grease is limited due to problems with compatibility with EPDM rubber.

When PAO-based lubricants come into contact with a double synthetic rubber (EPDM), which is a sealing material, they chemically attack the rubber, ultimately damaging the sealing material. In addition, glycol-based brake fluid has excellent low-temperature and room temperature characteristics, but has a fatal problem in that the lubricity is significantly reduced at high temperatures due to a low kinematic viscosity.

Therefore, there is a need for the development of a lubricant for an EBP, which has excellent compatibility with EPDM rubber and excellent high-temperature operability.

SUMMARY

The present disclosure aims to provide a lubricant composition for a brake system, which has excellent lubricity and excellent anti-wear and extreme-pressure properties.

The present disclosure also aims to provide a polyalkylene glycol-based lubricant composition that has excellent compatibility with a double synthetic rubber, which is a sealing material, and has improved high-temperature operability.

According to one aspect of the present disclosure, provided is a lubricant composition including, based on a total weight of the lubricant composition: 85 wt % to 95 wt % of a polyalkylene glycol base oil; 1 wt % to 5 wt % of an antioxidant; 1 wt % to 5 wt % of a first anti-wear extreme-pressure additive; and 1 wt % to 5 wt % of a second anti-wear extreme-pressure additive, wherein the antioxidant includes an amine-based compound, the first anti-wear extreme-pressure additive includes an amine salt of phosphate, and the second anti-wear extreme-pressure additive includes a nano-diamond dispersion.

The polyalkylene glycol base oil may have a kinematic viscosity at 40° C. in a range of 30 cst to 40 cSt.

The polyalkylene glycol base oil may include polyoxypropylene glycol, for example, butoxypolypropylene glycol.

The amine-based compound may include an alkyldiphenylamine.

The amine salt of phosphate may include an amine salt of dihexyl phosphate, and the first anti-wear extreme-pressure additive may further include monohexyl phosphate.

The nano-diamond dispersion may have a concentration of 0.05 wt % to 1 wt %, based on a total weight of the nano-diamond dispersion, and the nano-diamond dispersion may include nano-diamond particles having an average particle size of 3.0 nm to 10 nm.

The lubricant composition according to an embodiment of the present disclosure may have a kinematic viscosity at 40° C. in a range of 30 cst to 40 cst as measured by an ASTM D 7042 test method.

The lubricant composition according to an embodiment of the present disclosure may have a 4-Ball Wear in a range of 0.35 kgf to 0.40 kgf as measured by an ASTM D 2266 test method.

The lubricant composition according to an embodiment of the present disclosure may have a 4-Ball Extreme-Pressure in a range of 160 kgf to 200 kgf as measured by an ASTM D2596 test method.

The lubricant composition according to an embodiment of the present disclosure may be applied to an electronic parking brake (EPB).

BRIEF DESCRIPTION OF THE DRAWING

The FIGURE is a graph showing the rate of change in operating force of lubricant compositions according to Examples and Comparative Examples.

DETAILED DESCRIPTION

Hereinafter, the present disclosure is described in more detail with reference to embodiments and drawings. However, the following embodiments are provided as examples to help understanding of the present disclosure, and the scope of the present disclosure is not limited thereto. Various modifications may be made to the present disclosure, the present disclosure may be embodied in many different forms, and it is to be appreciated that all changes, equivalents, and substitutes that do not depart from the sprit and technical scope are encompassed in the present disclosure.

The terms used in the present specification are merely used to describe particular embodiments, and are not intended to limit the present disclosure. The expression of singularity in the present specification includes the expression of plurality unless clearly specified otherwise in context. In the present specification, it is to be appreciated that the terms such as "including", "having", and "comprising" are intended to indicate the existence of the features, numbers, steps, actions, components, parts, or combinations thereof disclosed in the specification, and are not intended to preclude the possibility that one or more other features, numbers, steps, actions, components, parts, or combinations thereof may exist or may be added.

Unless otherwise defined, all terms used herein, including technical or scientific terms, have the same meaning as generally understood by those of ordinary skill in the art. Terms defined in commonly used dictionaries should be interpreted as having a meaning consistent with the meaning in the context of the related art, and should not be interpreted in an ideal or overly formal sense unless explicitly defined in the present application.

In addition, the terms used in the embodiments of the present disclosure are for describing the embodiments and are not intended to limit the present disclosure.

In the present specification, the expression of singularity may include the expression of plurality unless the phrase specifically states otherwise, and the expression "at least one of A, B, and C" or "one or more of A, B, and C" may indicate one or more of all possible combinations of A, B, and C.

In addition, in the descriptions of components of the embodiment of the present disclosure, terms such as first, second, A, B, (a), and (b) may be used.

These terms are only for distinguishing one component from another, and the nature, sequence, or order of the components is not limited by these terms.

A lubricant composition according to an embodiment includes: 85 wt % to 95 wt % of a polyalkylene glycol base oil; 1 wt % to 5 wt % of an antioxidant; 1 wt % to 5 wt % of a first anti-wear extreme-pressure additive; and 1 wt % to 5 wt % of a second anti-wear extreme-pressure additive, wherein the antioxidant may include an amine-based compound, the first anti-wear extreme-pressure additive may include an amine salt of phosphate, and the second anti-wear extreme-pressure additive may include a nano-diamond dispersion.

Hereinafter, each of the components of the lubricant composition is described in detail.

<Polyalkylene Glycol Base Oil>

The base oil accounts for 85 wt % to 95 wt % of the lubricant composition. When polyalphaolefin (PAO)-based lubricants used in conventional brake systems come into contact with EPDM, which is a double synthetic rubber used as a sealing material, they chemically attack the rubber, causing damage to the sealing material, and the lubrication performance of glycol-based brake fluid is maintained low temperatures and room temperature, but the lubricity significantly decreases at high temperatures due to a low kinematic viscosity.

In order to solve these issues, in an embodiment, the following antioxidant and anti-wear extreme-pressure additive are added to a polyalkylene glycol-based lubricant composition to improve high-temperature operability, lubricity, and durability.

Polyalkylene glycol that may be used as the base oil for the lubricant composition may be a copolymer of an alcohol having 3 to 20 carbon atoms and propylene oxide, or polyoxypropylene glycol. For example, butoxypolypropylene glycol has a molecular weight of 790, a kinematic viscosity of 33 cSt at 40° C., a specific gravity of 0.98, and a flash point of 208° C., making it suitable for use as a lubricant base oil in brake systems.

<Antioxidant>

Generally, lubricants deteriorates due to temperature, metal catalysts, and oxygen to generate organic acids, which cause corrosion of metals. The antioxidant added to the lubricant composition according to the present disclosure deactivates free radicals generated in an early stage so that they no longer participate in a growth reaction, or decomposes oxidation products once generated to prevent them from being converted into stable compounds or acting as catalysts for oxidation of metals.

An amine-based compound may be used as the antioxidant. In detail, the amine-based compound may be a diphenylamine compound or a naphthylamine compound. For example, examples of the amine-based compound may include at least one compound selected from dioctyldiphenylamine, butyldiphenylamine, dinonyldiphenylamine, N-phenyl-1,2-phenylenediamine, N-phenyl-1,4-phenylenediamine, N-phenyl-α-naphthylamine, 4,4'-dibutyldiphenylamine, 4,4'-dipentyldiphenylamine, 4,4'-dihexyldiphenylamine, 4,4'-diheptyldiphenylamine, 4,4'-dioctyldiphenylamine, 4,4'-dinonyldiphenylamine, α-naphthylamine, phenyl-α-naphthylamine, butylphenyl-α-naphthylamine, pentylphenyl-α-naphthylamine, hexylphenyl-α-naphthylamine, heptylphenyl-α-naphthylamine, octylphenyl-α-naphthylamine, and nonylphenyl-α-naphthylamine. Furthermore, in addition to the amine-based compound, a phenol-based antioxidant or a quinoline-based antioxidant may also be used.

The content of the amine-based compound used as the antioxidant may be 1 wt % to 5 wt % of the total lubricant composition. When the content of the antioxidant is less than the above range, there is almost no anti-oxidation effect, whereas, when the content of the antioxidant is greater than the above range, it is not preferred because it is not economical and there is a risk of metal corrosion.

<Anti-Wear and Extreme-Pressure Additives>

The lubricant composition according to an embodiment of the present disclosure includes a mixture of two types of additives to enhance anti-wear and extreme-pressure properties.

Anti-wear additives are used to prevent surface wear during metal processing. Extreme-pressure (EP) additives prevent surface damage by inhibiting occurrence of metal wear due to breakage of an oil film when high pressure/high load is applied to a meal surface.

A phosphate amine compound may be used as the first anti-wear extreme pressure additive included in the lubricant composition. In detail, examples of the phosphate amine compound include alkylamine salts of mono and dihexyl phosphate, and preferably, in the compound, the content of nitrogen may be about 2.5 wt % and the content of phosphorus may be about 4.7 wt %.

In addition, a nano-diamond dispersion may be used as the second anti-wear extreme-pressure additive included in the lubricant composition. Nano-diamond particles are spherical, and preferably, the average diameter of the particles may be 3 nm to 10 nm.

A dispersion solvent of the nano-diamond dispersion may be Group 5 lubricating base oil, and it is suitable that the concentration of the dispersion is 0.05 wt % to 1 wt %. When the concentration of the nano-diamond dispersion is less than the above range, the lubricity and durability effects are minimal, whereas, when the concentration of the nano-diamond dispersion is greater than the above range, there is a possibility that sediment may occur later. In addition, when the average diameter of the nano-diamond particles is greater the above range, long-term dispersion stability may become problematic.

The lubricant composition according to an embodiment of the present disclosure may include 1 wt % to 5 wt % of each of the first anti-wear extreme-pressure additive and the second anti-wear extreme-pressure additive, based on the total weight of the composition.

The lubricant composition according to an embodiment has a kinematic viscosity at 40° C. in a range of 30 cst to 40 cSt as measured by an ASTM D 7042 test method, indicating excellent high-temperature operability.

The lubricant composition according to an embodiment has a 4-Ball Wear in a range of 0.35 kgf to 0.40 kgf as measured by an ASTM D2266 test method, and has a 4-Ball Extreme-Pressure in a range of 160 kgf to 200 kgf as measured by an ASTM D2596 test method, indicating excellent anti-wear and extreme-pressure properties.

As such, the lubricant composition according to an embodiment has excellent high-temperature operability and excellent anti-wear properties, making it suitable for application in electronic parking brakes (EPBs).

Examples

According to the composition in [Table 1] below, base oil and additives were prepared to prepare lubricant compositions according to Examples and Comparative Examples.

TABLE 1

| | | Example 1 | Example 2 | Example 3 | Comparative Example 1 | Comparative Example 2 |
|---|---|---|---|---|---|---|
| Base oil | butoxypolypropylene glycol (kinematic viscosity: 34) | 94 | 92 | 90 | 95 | |
| | butoxypolypropylene glycol (kinematic viscosity: 76) | | | | | 94 |
| Additive | p, p'-dioctyldiphenylamine | 2 | 2 | 2 | 2 | 2 |
| | amine, $C_{11-14}$-branched alkyl, monohexyl, and dihexyl phosphate | 3 | 3 | 3 | 3 | 3 |
| | nano-diamond dispersion | 1 | 3 | 5 | | 1 |

Experimental Example 1

The properties of the lubricant compositions according to Examples and Comparative Examples were measured according to the following measurement methods, and results thereof are shown in [Table 2].

(1) Kinematic Viscosity

The kinematic viscosity is measured at 40° C. by using a viscometer (Stabinger viscometer) according to ASTM D 7042. The viscometer is a device that measures the viscosity or specific gravity of oil filled in a cylinder through rotation of an external cylinder (tube) and an internal cylinder (rotor), and is capable of measurement within a range of −56° C. to 105° C. and requires about 2.5 ml of sample.

(2) Copper Strip Corrosion

The degree of copper strip corrosion is measured according to ASTM D 4048 and KS M 2088 test methods. A copper plate with dimensions of 76 mm×12.7 mm×1.0 mm is polished and inserted into a lubricant filled in a specified container, and then, after a certain period of time (three hours) at a specified temperature (100° C.), the copper plate is inspected for discoloration. A sulfur component in oil is known to be a cause of cooper corrosion.

(3) Pour Point

The pour point is measured according to ASTM D 97 and KS M ISO 3016 test methods. The pour point is the lowest temperature at which oil flows when the oil is cooled without stirring, and is expressed as an integer multiple of 2.5° C., starting from 0° C.

After cooling a 45 ml of sample in a test tube, whenever the temperature of the sample drops by 2.5° C., the test tube is taken out of a cooling bath, the temperature at which the sample does not move at all for five seconds is read, and a result obtained by adding 2.5 to this value is determined as the pour point.

(4) Flash Point

The flash point is measured according to ASTM D 92 and KS M ISO 2592 test methods. The flash point is the lowest temperature at which ignition occurs when a flame is brought close to the vapor of a sample at an atmospheric pressure of 101.3 Kpa, and at which ignition occurs on a liquid surface under specified conditions. The sample is filled in a sample cup to a specified level. At first, the temperature of the sample increases rapidly and then increases slowly at regular intervals as it approaches the flash point. A small test flame is passed over the sample cup at specified temperature intervals, and the lowest temperature at which the test flame ignites the vapor above the liquid surface is determined as the flash point at ambient atmospheric pressure. The flash point measured at atmospheric pressure is corrected to standard atmospheric pressure by using an equation.

Results of measuring the kinematic viscosity, copper strip corrosion, 4-ball wear, and 4-ball extreme-pressure (EP) of the lubricant components according to Examples and Comparative Examples are as shown in [Table 2].

TABLE 2

| Evaluation item | Test standard | Property measurement result | | | | |
|---|---|---|---|---|---|---|
| | | Example 1 | Example 2 | Example 3 | Comparative Example 1 | Comparative Example 2 |
| Kinematic viscosity, cSt (40° C.) | ASTM D 7042 | 34.6 | 34.2 | 34.0 | 34.8 | 76.4 |
| Copper strip corrosion | ASTM D130 | 1a | 1a | 1a | 1a | 1a |
| 4-Ball Wear, mm | ASTM D 2266 | 0.38 | 0.38 | 0.36 | 0.42 | 0.43 |
| 4-Ball EP, kgf | ASTM D 2596 | 160 | 160 | 160 | 160 | 160 |
| SRV wear test COF average | ASTM D 5707 | 0.127 | 0.113 | 0.103 | 0.136 | 0.142 |

TABLE 3

| Test item | | Test method | Example 1 | Comparative Example 1 | Comparative Example 2 |
|---|---|---|---|---|---|
| Base oil | | | polypropylene glycol | polyethylene glycol (diethylene glycol) | polypropylene glycol |
| Kinematic viscosity (cSt) | 40° C. | ASTM D 7042 | 34.6 | 7.5 | 320 |
| | 100° C. | | 6.9 | 2.2 | 42 |
| | −40° C. | | 32,400 | 1,173 | Not evaluable |
| Pour point (° C.) | | ASTM D 97 | −51° C. | <−60° C. | −32° C. |
| Flash point (° C.) | | ASTM D 92 | 246 | 126 | 249 |
| Specific gravity (15/4° C.) | | ASTM D 7042 | 0.98 | 1.05 | 1.00 |
| Copper strip corrosion | | ASTM D 130 | 1a | 1a | 1a |
| 4-Ball Wear (mm) | | ASTM D 2266 | 0.38 | 0.69 | 0.63 |
| 4-Ball EP (kgf) | | ASTM D 2596 | 160 | 126 | 250 |
| SRV wear test | COF average | ASTM D 5707 | 0.127 | 0.148 | 0.1123 |

Experimental Example 2

Brake fluid conventionally used was prepared as Comparative Example 3 according to the composition in [Table 4] below.

TABLE 4

| Comparative Example 3 | CAS No | Content (wt %) |
|---|---|---|
| polyethylene glycol methyl ether | 9004-74-4 | 5~10 |
| polyethylene glycol monobutyl ether | 9004-77-7 | 1~10 |
| triethyleneglycol monomethyl ether | 112-35-6 | 25-40 |
| tris[2-[2-(2-methoxyethoxy)ethoxy]ethyl] orthoborate | 30989-05-0 | 45-60 |
| Other additives | | Max 5 |

The rate of change in operating force of electronic parking brake systems employing the lubricants of Example 1 and Comparative Example 3 was measured according to the following test modes, and results thereof were compared.

1) Test Mode 1

The test was conducted under two conditions (phases): a room temperature condition test; and a voltage/temperature-specific condition test. The room temperature condition test was conducted to measure the operating force after three cycles of operation at 12 V and room temperature, and the voltage/temperature-specific condition test was conducted to measure the operating force after three cycles of operation at 12 V and each temperature, including −40° C., −20° C., 0° C., 20° C., 80° C., 100° C., and 120° C., and three cycles of operation at 9 V and 16 V under the same temperature conditions.

2) Test Mode 2 (Thermal Shock Durability)

Thermal shock durability was tested through a total of 100,000 cycles of operation while varying the temperature between −20° C. and 85° C.

3) Test Mode 3 (High Temperature and High Humidity)

High-temperature and high-humidity durability was measured by leaving it for a total of 240 hours at a temperature of 85° C. and a humidity of 85%. 47 hours of non-operation and one hour of operation were defined as one cycle (48 hours), and this cycle was repeated five times, indicating that it was left for 240 hours.

4) Test Mode 4 (Thermal Shock)

Leaving it for 30 minutes at each of temperatures of 40° C. and 115° C. was defined as one cycle, and this cycle was repeated 200 times.

The FIGURE is a graph showing the rate of change in operating force of the brake systems employing the lubricants of Example 1 and Comparative Example 3 in each of the test modes. In the FIGURE, the left graph shows the operating forces of the brake system employing the existing lubricant according to Comparative Example 3 before (A-1) and after (A-2) Test Mode 1, whereas the right graph shows the operating forces of the brake system employing the lubricant according to Example 1 of the present disclosure before (B-1) and after (B-2) Test Mode 1. These results indicate that the performance of the brake system employing the lubricant composition according to Example 1 was significantly improved due to a decrease in the change in operating force.

The content of moisture in each of the lubricant compositions of Comparative Example 3 and Example 1 before and after ES was measured, and results thereof are shown in [Table 5] below. It could be seen that the lubricant composition according to Example 1 had less moisture content than the conventional brake fluid lubricant according to Comparative Example 3, indicating an improvement in the performance of the lubricant.

TABLE 5

| | | | Thermal shock durability test sample (Test Mode 2) | | High-temperature and high-humidity test sample (Test Mode 3) | |
|---|---|---|---|---|---|---|
| Test item | Comparative Example 3 | Example 1 | Comparative Example 3 | Example 1 | Comparative Example 3 | Example 1 |
| Moisture content, wt % | 0.14 | 0.17 | 2.18 | 0.23 | 4.75 | 0.43 |

The operating force of each of the lubricants of Example 1 and Comparative Example 3 after Test Mode 2 was measured, and results thereof are shown in [Table 6]. A test was conducted based on the operating force required on a SPOT 30% incline, and evaluation was conducted with an input current value of 10 A. The rate of change in operating force compared to room temperature was expressed as minimum/average/maximum values. From results of the measurement, it could be seen that the lubricant composition according to Example 1 had very excellent performance at high temperatures compared to the conventional brake fluid according to Comparative Example 3.

TABLE 6

| | High temperature (85° C.) | | | High temperature (120° C.) | | |
|---|---|---|---|---|---|---|
| | Min | Avg | Max | Min | Avg | Max |
| Comparative Example 3 | −11 | −10 | −10 | −36 | −36 | −36 |
| Example 1 | −9 | −8 | −7 | −9 | −8 | −7 |

A polyalkylene glycol-based lubricant composition according to an embodiment of the present disclosure has excellent compatibility with a double synthetic rubber (EPDM), which is a sealing material for brake systems, excellent lubricity, and excellent durability. The polyalkylene glycol-based lubricant composition includes polyalkylene glycol as a base oil, allowing it to remain in a liquid state unlike grease, and thus, not only has excellent low-temperature performance but also exhibits a high viscosity index compared to conventional glycol-based brake fluid, indicating excellent high-temperature stability. In addition, the lubricant composition according to an embodiment includes an antioxidant and two types of anti-wear extreme-pressure additives, and thus, may have excellent durability, and may improve the operating performance of electronic parking brakes across a variety of temperature ranges.

Hereinbefore, the present disclosure has been described with reference to preferred embodiments thereof, but it will be understood by those skilled in the art that various modifications and changes may be made to the present disclosure without departing from the spirit and scope of the present disclosure as defined by the appended claims.

What is claimed is:

1. A lubricant composition comprising, based on a total weight of the lubricant composition:

85 wt % to 95 wt % of a polyalkylene glycol base oil;

1 wt % to 5 wt % of an antioxidant;

1 wt % to 5 wt % of a first anti-wear extreme-pressure additive; and 1 wt % to 5 wt % of a second anti-wear extreme-pressure additive, wherein the antioxidant comprises an amine-based compound, the first anti-wear extreme-pressure additive comprises an amine salt of phosphate, and the second anti-wear extreme-pressure additive comprises a nano-diamond dispersion.

2. The lubricant composition of claim 1, wherein the polyalkylene glycol base oil has a kinematic viscosity at 40° C. in a range of 30 cst to 40 cSt.

3. The lubricant composition of claim 2, wherein the polyalkylene glycol base oil includes butoxypolypropylene glycol.

4. The lubricant composition of claim 1, wherein the amine-based compound comprises an alkyldiphenylamine.

5. The lubricant composition of claim 1, wherein the amine salt of phosphate includes an amine salt of dihexyl phosphate, and the first anti-wear extreme-pressure additive further comprises monohexyl phosphate.

6. The lubricant composition of claim 1, wherein the nano-diamond dispersion has a concentration of 0.05 wt % to 1 wt %, based on a total weight of the nano-diamond dispersion, and the nano-diamond dispersion includes nano-diamond particles having an average particle size of 3.0 nm to 10 nm.

7. The lubricant composition of claim 1, wherein the lubricant composition has a kinematic viscosity at 40° C. in a range of 30 cst to 40 cst as measured by an ASTM D 7042 test method.

8. The lubricant composition of claim 1, wherein the lubricant composition has a 4-Ball Wear in a range of 0.35 kgf to 0.40 kgf as measured by an ASTM D 2266 test method.

9. The lubricant composition of claim 1, wherein the lubricant composition has a 4-Ball Extreme-Pressure in a range of 160 kgf to 200 kgf as measured by an ASTM D2596 test method.

10. The lubricant composition of claim 1, wherein the lubricant composition is applied to an electronic parking brake (EPB).

* * * * *